US008615902B2

(12) United States Patent
Macey et al.

(10) Patent No.: US 8,615,902 B2
(45) Date of Patent: Dec. 31, 2013

(54) ARTICLE OF FOOTWEAR WITH A SOLE STRUCTURE HAVING SUPPORT ELEMENTS AND AN INDENTED PLATE

(75) Inventors: Tony Macey, Westlake Village, CA (US); Scott Portzline, Portland, OR (US); Michael Hui, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 138 days.

(21) Appl. No.: 13/115,177

(22) Filed: May 25, 2011

(65) Prior Publication Data

US 2011/0219553 A1 Sep. 15, 2011

Related U.S. Application Data

(62) Division of application No. 11/875,630, filed on Oct. 19, 2007, now Pat. No. 7,971,372.

(51) Int. Cl.
*A43B 21/28* (2006.01)
*A43B 13/20* (2006.01)

(52) U.S. Cl.
USPC ..... 36/35 B; 36/29

(58) Field of Classification Search
USPC ..... 36/35 B, 29, 28, 103, 27, 35 R
See application file for complete search history.

(56) References Cited

U.S. PATENT DOCUMENTS

| | | | | |
|---|---|---|---|---|
| 6,880,267 | B2 | 4/2005 | Smaldone et al. | |
| 6,964,120 | B2 | 11/2005 | Cartier et al. | |
| 7,082,698 | B2 | 8/2006 | Smaldone et al. | |
| 7,793,428 | B2 | 9/2010 | Shenone | |
| 7,971,372 | B2 * | 7/2011 | Macey et al. | 36/35 B |
| 2007/0294916 | A1 | 12/2007 | Park | |
| 2008/0078101 | A1 | 4/2008 | Smith et al. | |

OTHER PUBLICATIONS

Non-Final Office Action for related U.S. Appl. No. 13/115,187 mailed Dec. 27, 2012.
Final Office Action for related U.S. Appl. No. 13/115,187 mailed Jun. 7, 2013.

* cited by examiner

*Primary Examiner* — Ted Kavanaugh
(74) *Attorney, Agent, or Firm* — Banner & Witcoff, Ltd.

(57) ABSTRACT

An article of footwear is disclosed that includes an upper and a sole structure secured to the upper. The sole structure incorporates a support element that includes a fluid-filled chamber, a first insert, and a second insert. The chamber defines a first surface, an opposite second surface, and a sidewall extending between the first surface and the second surface. The first insert is secured to the first surface and at least partially recessed into the polymer material of the chamber, and the second insert is secured to the second surface. In addition, the chamber may be pressurized to deform the first insert or the second insert.

13 Claims, 12 Drawing Sheets

ARTICLE OF FOOTWEAR WITH A SOLE STRUCTURE HAVING SUPPORT ELEMENTS AND AN INDENTED PLATE

RELATED APPLICATION

This application is a divisional of U.S. Ser. No. 11/875,630 filed Oct. 19, 2007, now allowed, entitled "Article Of Footwear With A Sole Structure Having Support Elements And An Indented Plate," which is incorporated herein by reference in its entirety.

BACKGROUND

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces, the sole structure may provide traction, control foot motions (e.g., by resisting over pronation), and impart stability, for example. Accordingly, the upper and the sole structure operate cooperatively to provide a comfortable structure that is suited for a wide variety of athletic activities.

The sole structure generally incorporates multiple layers that are conventionally referred to as an insole, a midsole, and an outsole. The insole is a thin, compressible member located within the upper and adjacent to a plantar (i.e., lower) surface of the foot to enhance footwear comfort. The midsole, which may be secured to the upper along the length of the upper, forms a middle layer of the sole structure and is primarily responsible for attenuating ground reaction forces. The outsole forms the ground-contacting element of footwear and is usually fashioned from a durable, wear-resistant material that includes texturing to improve traction.

The conventional midsole is primarily formed from a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders or moderators.

Another type of sole structure incorporates various polymer foam support elements, which may be positioned in a heel region of the footwear. Examples of footwear that incorporate support elements include U.S. Pat. Nos. 5,353,523 and 5,343,639 to Kilgore, et al.; U.S. Pat. No. 6,487,796 to Avar, et al.; and U.S. Pat. No. 6,898,870 to Rohde, each of which is incorporated by reference herein. The support elements may have a generally cylindrical configuration, and each of the support elements may extend between two semi-rigid plates and through a void in the sole structure.

SUMMARY

Various embodiments of the invention involve an article of footwear having an upper and a sole structure secured to the upper. The sole structure includes a midsole, at least four support elements, and a plate. The midsole defines a void positioned in a heel region of the footwear and extending through a medial side of the footwear and a lateral side of the footwear, with the void having an upper surface and an opposite lower surface. The support elements are located within the void and extend between the upper surface and the lower surface. The plate extends under the support elements and defines a plurality of indentations extending inward from an edge of the plate. Each of the indentations extend between two of the support elements, and each of the indentations have a depth that is in a range of one-eighth to one-half of a width of the plate.

The indentations may include a first indentation and a second indentation. The first indentation may extend inward from the lateral side of the footwear, and the second indentation may extend inward from the medial side of the footwear. In this configuration, the depth of the first indentation may be greater than the depth of the second indentation. The indentations may also include a third indentation extending inward from a rearward portion of the footwear.

The support elements may be arranged in a variety of configurations. As an example, the support elements may be positioned such that a first pair of the support elements are located adjacent the lateral side and a second pair of the support elements are located adjacent the medial side. In this configuration, the first indentation may extend between the first pair and the second indentation may extend between the second pair.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

Introduction

The following discussion and accompanying figures disclose an article of footwear having support elements in accordance with aspects of the present invention. Concepts related to the support elements are disclosed with reference to footwear having a configuration suitable for the sport of running The support elements are not solely limited to footwear designed for running, however, and may be incorporated into a wide range of athletic footwear styles, including shoes that are suitable for baseball, basketball, football, rugby, soccer, tennis, volleyball, and walking, for example. In addition, the support elements may be incorporated into footwear that is generally considered to be non-athletic, including a variety of dress shoes, casual shoes, sandals, and boots. An individual skilled in the relevant art will appreciate, therefore, that the concepts disclosed herein with regard to the support elements apply to a wide variety of footwear styles, in addition to the specific style discussed in the following material and depicted in the accompanying figures.

Figure 1A:
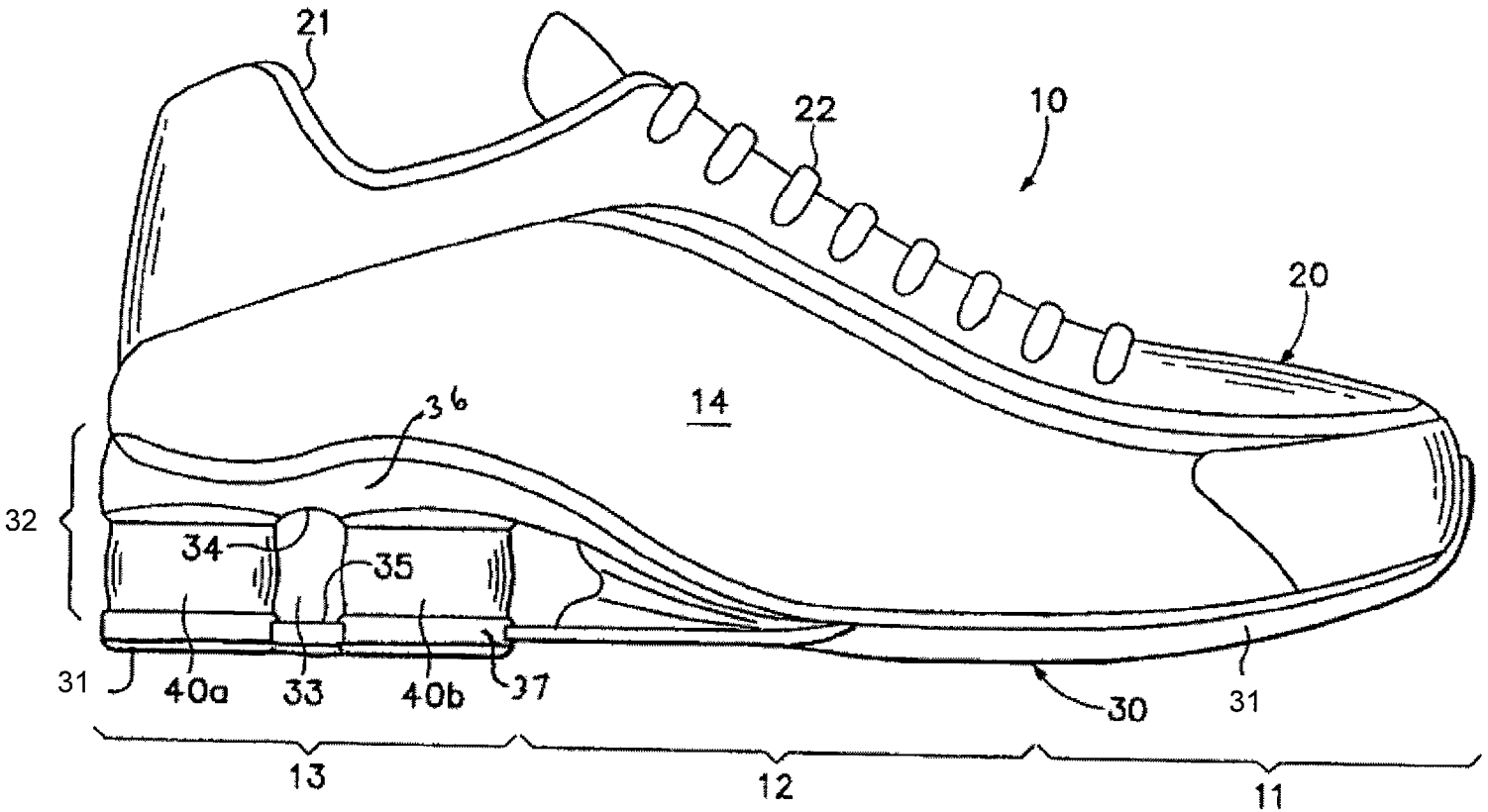
FIG. 1A is a lateral side elevational view of an article of footwear.
Figure 1B:
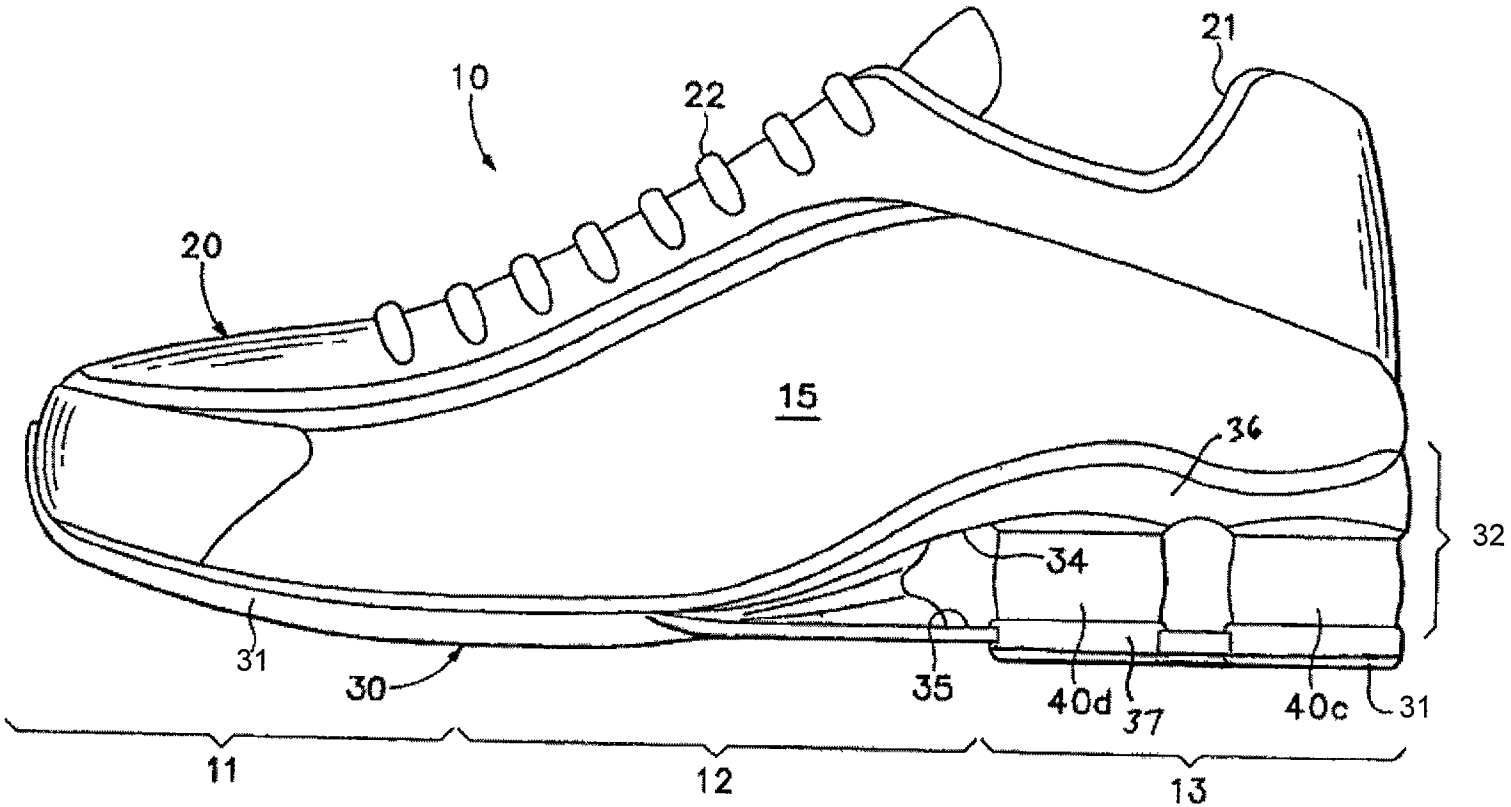
FIG. 1B is a medial side elevational view of the article of footwear.

An article of footwear 10 is depicted in FIGS. 1A and 1B as including an upper 20 and a sole structure 30. For purposes of reference in the following material, footwear 10 may be divided into three general regions: a forefoot region 11, a midfoot region 12, and a heel region 13, as defined in FIGS. 1A and 1B. In addition, footwear 10 includes two sides: lateral side 14 and medial side 15, as also defined in FIGS. 1A and 1B. Lateral side 14 is positioned to extend along a lateral side of the foot and generally passes through each of regions 11-13. Similarly, medial side 15 is positioned to extend along an opposite medial side of the foot and generally passes through each of regions 11-13. Regions 11-13 and sides 14-15 are not intended to demarcate precise areas of footwear 10. Rather, regions 11-13 and sides 14-15 are intended to represent general areas of footwear 10 that provide a frame of reference during the following discussion. Although regions 11-13 and sides 14-15 apply generally to footwear 10, references to regions 11-13 and sides 14-15 may also apply specifically to upper 20, sole structure 30, or an individual component within either upper 20 or sole structure 30.

Upper 20 is secured to sole structure 30 and defines a cavity for receiving a foot. Access to the cavity is provided by an ankle opening 21 located in heel region 11. A lace 22 extends in a zigzag pattern through various apertures in upper 20. Lace 22 may be utilized in a conventional manner to selectively increase a size of ankle opening 21 and modify certain dimensions of upper 20, particularly girth, to accommodate feet with varying dimensions. Various materials are suitable for upper 20, including leather, synthetic leather, rubber, textiles, and polymer foams, for example, that are stitched or adhesively bonded together. The specific materials utilized for upper 20 may be selected to impart wear-resistance, flexibility, air-permeability, moisture control, and comfort. More particularly, different materials may be incorporated into different areas of upper 20 in order to impart specific properties to those areas. Furthermore, the materials may be layered in order to provide a combination of properties to specific areas. Although the configuration of upper 20 discussed above is suitable for footwear 10, upper 20 may exhibit the configuration of any conventional or non-conventional upper.

Sole structure 30 is secured to a lower surface of upper 20 and includes an outsole 31 and a midsole 32. Outsole 31 forms a ground-engaging surface of sole structure 30 and is formed of a durable, wear-resistant material, such as rubber, that is textured to enhance traction. In some embodiments, outsole 31 may be formed integral with midsole 32 or may be a lower surface of midsole 32. A conventional midsole is primarily formed of a polymer foam material, such as polyurethane or ethylvinylacetate, as discussed in the Background of the Invention section. In contrast with the structure of a conventional midsole, midsole 32 defines a void 33 in heel region 13 that includes four support elements 40*a*-40*d*. Void 33 extends through sole structure 30 from lateral side 14 to medial side 15 and has an upper surface 34 and an opposite lower surface 35. Although midsole 32 may be substantially formed from a polymer foam material, midsole 32 is depicted as having an upper plate 36 and a lower plate 37 that defines void 33. More particularly, upper plate 36 forms upper surface 34, and lower plate 37 forms lower surface 35. Each of support elements 40*a*-40*d* extend between surfaces 34 and 35, thereby extending between plates 36 and 37, to provide ground reaction force attenuation as footwear 10 impacts the ground during running, walking, or other ambulatory activities. In addition, support elements 40*a*-40*d* may impart stability or otherwise control foot motions, such as the degree of pronation. Sole structure 30 may also include an insole positioned within the cavity formed by upper 20 and located to contact a plantar (i.e., lower) surface of the foot, thereby enhancing the overall comfort of footwear 10.

Lower Plate Structure

Figure 2A:
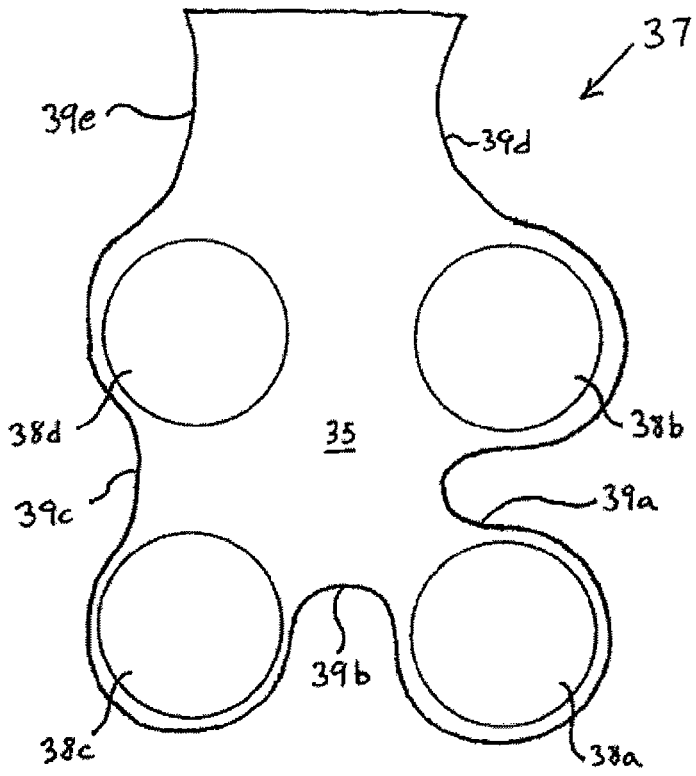
FIG. 2A is a top plan view of a plate of the article of footwear.
Figure 2B:
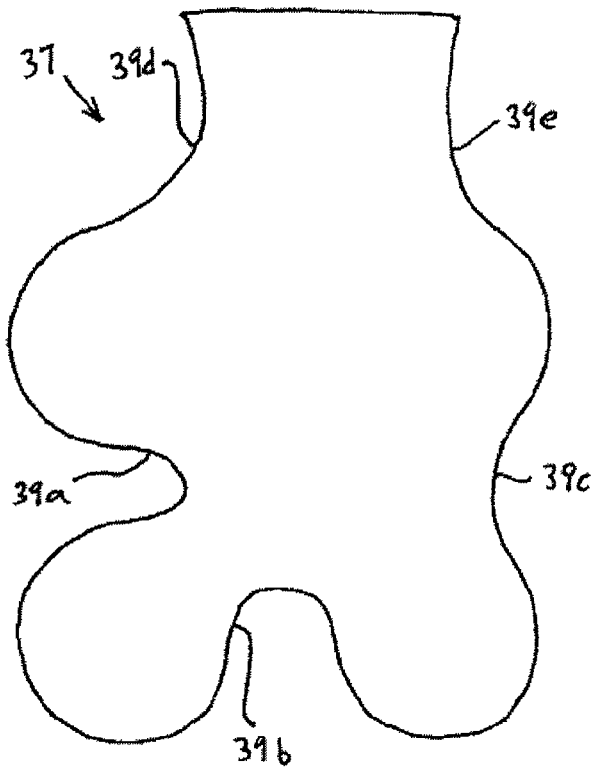
FIG. 2B is a bottom plan view of the plate.

Lower plate 37 is depicted individually in FIGS. 2A and 2B. With respect to footwear 10, lower plate 37 defines lower surface 35 and extends under support elements 40*a*-40*b*. Although lower plate 37 is depicted as extending through heel region 13 and portions of midfoot region 12, lower plate 37 may be limited to heel region 13 or extend through each of regions 11-13 in some configurations of footwear 10. Whereas a lower portion of lower plate 37 is depicted as having a generally smooth configuration in FIG. 2B, an upper portion of lower plate 37 (i.e., lower surface 35) defines four raised areas 38*a*-38*d* that respectively receive support elements 40*a*-40*d*. Areas 38*a*-38*d* are arranged such that area 38*a* is positioned adjacent lateral side 14, area 38*b* is positioned adjacent lateral side 14 and forward of area 38*a*, area 38*c* is positioned adjacent medial side 15, and area 38*d* is positioned adjacent medial side 15 and forward of area 38*c*. Accordingly, areas 38*a*-38*d* are arranged in a square configuration. In further embodiments, areas 38*a*-38*d* may be offset from each other, or a lesser or greater number of areas may be utilized depending upon the number of support elements. Areas 38*a*-38*d* are formed as circular rims that extend upward from the upper portion of lower plate 37. In an alternate arrangement, areas 38*a*-38*d* may be formed as numerous other shapes, such as triangular, oval, elongated circle, and the like. In some configurations, areas 38*a*-38*d* may be depressions or other structures that receive support elements 40*a*-40*d*.

Areas 38*a*-38*d* respectively correspond with the positions of support elements 40*a*-40*d*. Lower plate 37 extends under, therefore, each of support elements 40*a*-40*d*. In areas between support elements 40*a*-40*d* and forward of support elements 38*b* and 38*d*, lower plate 37 defines various indentations 39*a*-39*e* that extend inward from outer edges of lower plate 37. Indentation 39*a* extends inward between areas 38*a* and 38*b*, indentation 39*b* extends inward between areas 38*a* and 38*c*, and indentation 39*c* extends inward between areas 38*c* and 38*d*. In addition, indentation 39*d* protrudes inward in a portion of lower plate 37 that is forward of area 38*b*, and indentation 39*e* protrudes inward in a portion of lower plate 37 that is forward of area 38*d*.

Indentation 39*a*, which is positioned adjacent lateral side 14, protrudes inward to a greater degree than indentations 39*b*-39*e*. As depicted in FIGS. 2A and 2B, indentation 39*a* has a depth (i.e., a distance inward from an outer edge of lower plate 37) that extends to inward portions of areas 38*a* and 38*b*. That is, the depth of indentation 39*a* is approximately one-third to one-half of the overall width of lower plate 37, or may be considered equal to the diameter of areas 38*a* and 38*b*. Similarly, indentation 39*b* has a depth that extends to inward portions of areas 38*a* and 38*c*, but to a lesser depth than indentation 39*a*. That is, the depth of indentation

39*b* is also approximately one-third to one-half of the overall width of lower plate 37, or may be considered equal to the diameter of areas 38*a* and 38*c*, but is less than the depth of indentation 39*a*. Finally, the depth of indentation 39*c* is less than either of indentations 39*a* and 39*b*, and is equal to a fraction of the diameter of areas 38*c* and 38*d*.

An advantage of indentations 39*a*-39*e* relates to the ability of support elements 40*a*-40*d* to deflect independently as footwear 10 impacts the ground. The motion of the foot during running proceeds as follows: Initially, the heel strikes the ground, followed by the ball of the foot. As the heel leaves the ground, the foot rolls forward so that the toes make contact, and finally the entire foot leaves the ground to begin another cycle. During the time that the foot is in contact with the ground and rolling forward, it also rolls from the outside or lateral side to the inside or medial side, a process called pronation. While the foot is air-borne and preparing for another cycle, the opposite process, called supination, occurs. Given this motion for the foot, the first portion of footwear 10 to contact the ground is the portion of outsole 31 located under area 38*a* and support element 40*a*. Indentations 39*a* and 39*b* permit support element 40*a* to deflect or otherwise compress independent of support elements 40*b*-40*d*. Another advantage is that indentations 39*a*-39*e* decrease the overall mass of footwear 10 by decreasing the amount of material utilized in footwear 10. In comparison with footwear having no indentations, footwear 10 will generally have a lesser mass, which contributes to the overall athletic performance of the wearer.

The degree to which support elements 40*a*-40*d* deflect or compress independently is at least partially related to the depth of indentations 39*a*-39*e*. With regard to support element 40*a*, for example, the depth of indentations 39*a* and 39*b* is directly related to the degree of independence of support element 40*a*. More particularly, as the depth of indentations 39*a* and 39*b* increases, the degree to which support element 40*a* deflects or compresses independently also increases. Similarly, as the depth of indentations 39*a* and 39*b* decreases, the degree to which support element 40*a* deflects or compresses independently also decreases. By varying the depth of indentations 39*a*-39*e*, therefore, the degree to which support elements 40*a*-40*d* deflect or compress independently may be modified to suit the needs of the wearer or the demands of a particular athletic activity, for example.

Figure 2C:
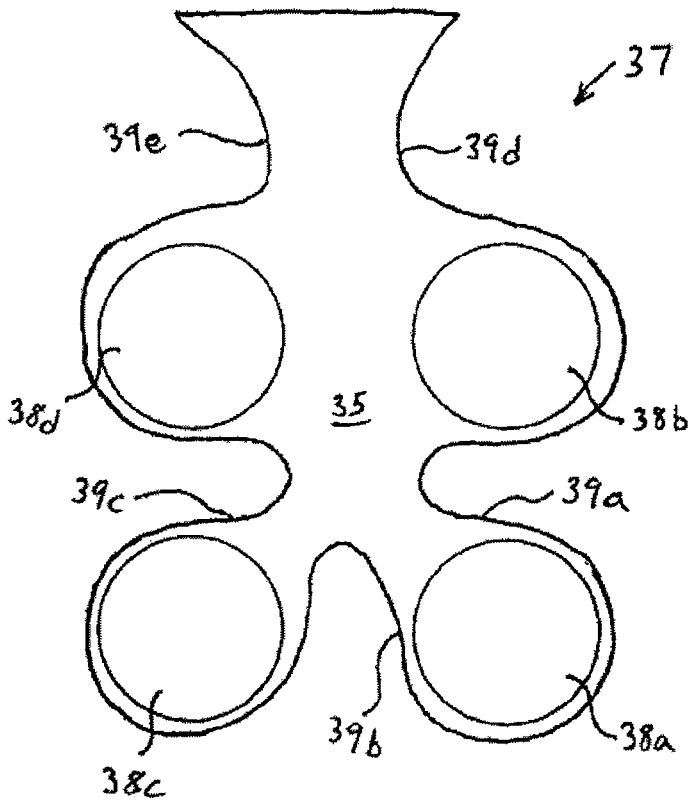
FIGS. 2C-2F are top plan views of alternate configurations of the plate.

Another configuration for lower plate 37 is depicted in FIG. 2C. In comparison with the configuration depicted in FIGS. 2A and 2C, each of indentations 39*a*-39*e* extend inward to a greater degree. For example, each of indentations 39*a*-39*c* have a depth that extends to inward portions of areas 38*a* and 38*b*. That is, the depth of indentation 39*a*-39*c* is approximately one-third to one-half of the overall width of lower plate 37, or may be considered equal to the diameter of areas 38*a* and 38*b*. In comparison with the configuration of lower plate 37 in FIGS. 2A and 2B, in which each of indentations 39*a*-39*c* have different depths, indentations 39*a*-39*c* in FIG. 2C have substantially similar depths.

Figure 2D:
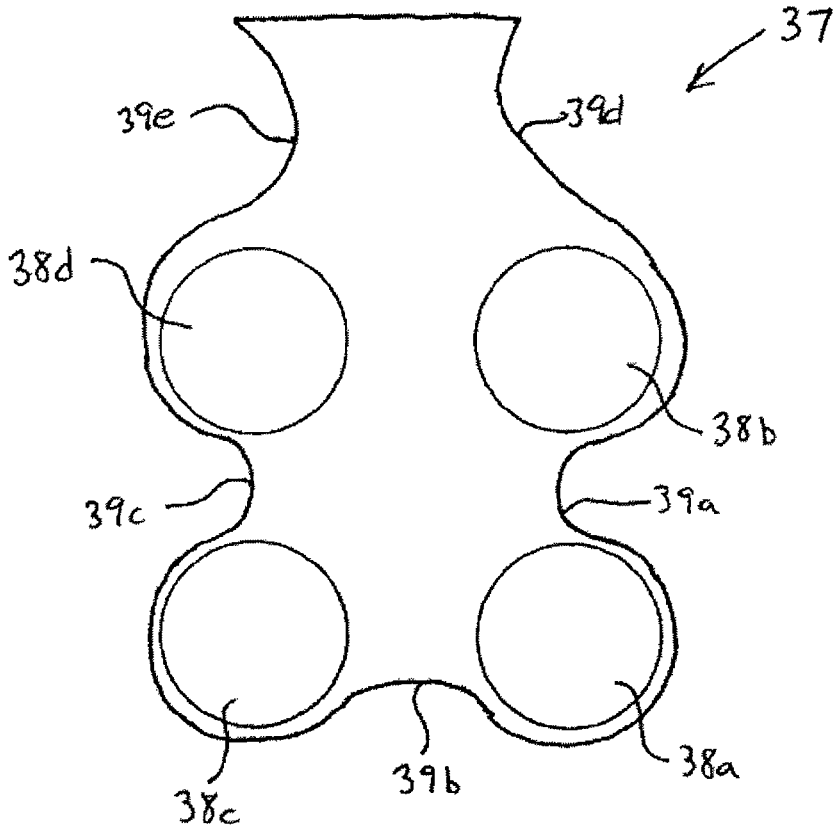

A further configuration for lower plate 37 is depicted in FIG. 2D, in which indentations 39*a* and 39*c* extend inward approximately one-fourth of the overall width of lower plate 37. In addition, indentation 39*b* extends inward approximately one-eighth of the overall width of lower plate 37. In this configuration, the deflection of support elements 40*a* and 40*c* may be somewhat tied in that the depth of indentation 39*b* is relatively shallow. The greater depth of indentations 39*a* and 39*c*, however, may decouple the deflections of support elements 40*a* and 40*c* from the deflections of support elements 40*b* and 40*d*. Accordingly, indentations 39*a*-39*c* may be utilized to isolate the deflections of rearward support elements 40*a* and 40*c* from forward support elements 40*b* and 40*d*.

Figure 2E:
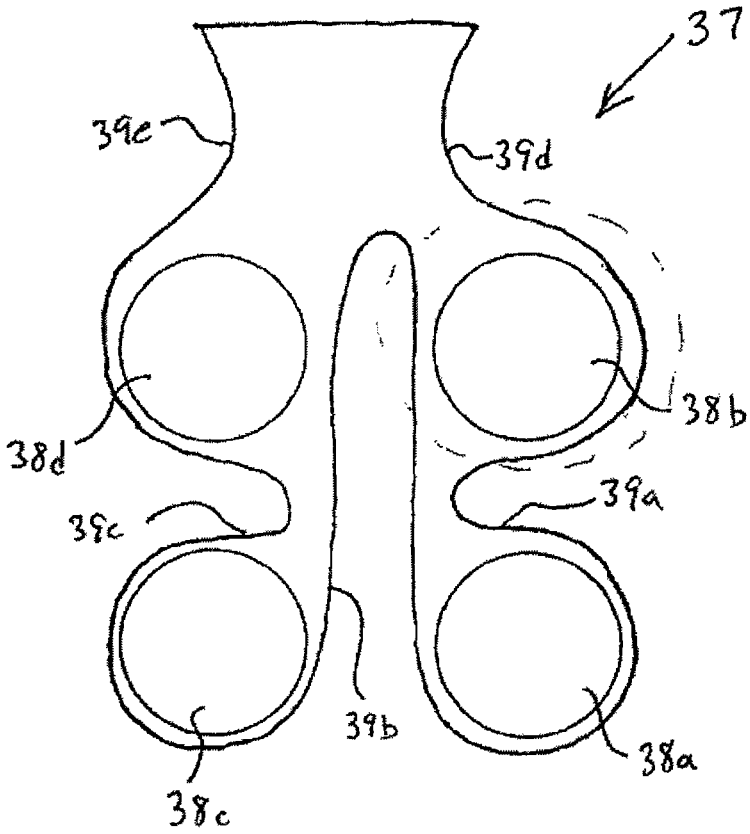

Yet another configuration for lower plate 37 is depicted in FIG. 2E, in which indentations 39*a* and 39*c* extend inward approximately one-third to one-half of the overall width of lower plate 37. In addition, indentation 39*b* extends inward approximately the entire width of lower plate 37 and to a distance that places an end of indentation 39*b* adjacent each of areas 38*b* and 38*d*. In this configuration, the deflection of each of support elements 40*a*-40*d* may be more independent than in the configuration of FIG. 2C. The greater depth of indentations 39*a* and 39*c*, however, may decouple the deflections of support elements 40*a* and 40*c* from the deflections of support elements 40*b* and 40*d*. Accordingly, indentations 39*a*-39*c* may be utilized to isolate the deflections of rearward support elements 40*a* and 40*c* from forward support elements 40*b* and 40*d*.

Figure 2F:
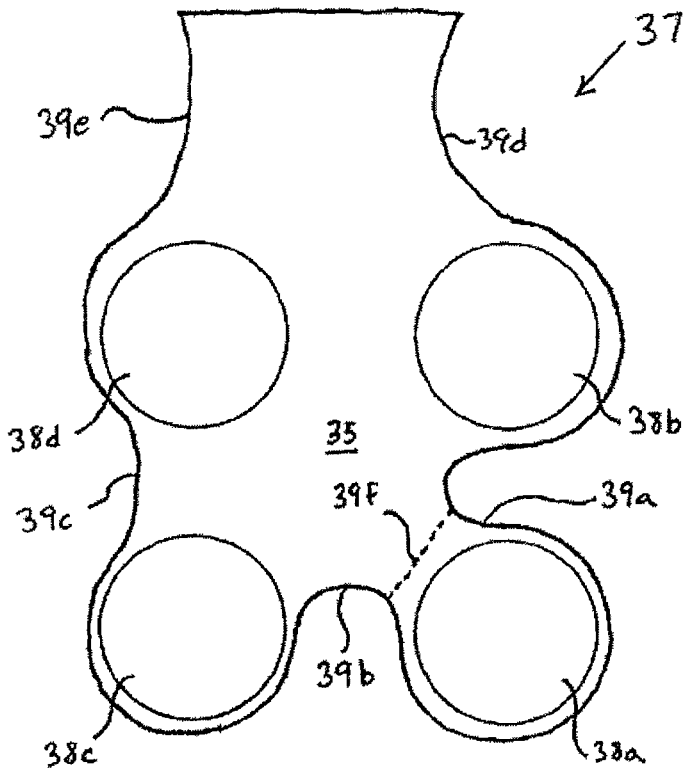

Lower plate 37 may be formed from a variety of polymer materials, including polyurethane, thermoplastic polyurethane, nylon, polyether block amide, and polybutylene terephthalate, for example. In order to enhance bonding between lower plate 37 and support elements 40*a*-40*d*, lower plate 37 may be formed from materials that are utilized for one or more components of support elements 40*a*-40*d*. In addition to the materials noted above, therefore, lower plate 37 may be formed or partially formed from any of the materials discussed below for the various components of support elements 40*a*-40*d*. In some configurations, lower plate 37 may also be formed from two different polymer materials or different densities of polymer materials. With reference to FIG. 2F, a line 39*f* is depicted and may separate areas of lower plate 37 with different polymer materials. In this configuration, a majority of lower plate 37 (i.e., the portions encompassing areas 39*b*-39*d*) may be formed from a first material and the remainder of lower plate 37 (i.e., the portion encompassing area 38*a*) may be formed of a second material. If the first material is less flexible than the second material, then the portion associated with area 38*a* and support element 40*a* may deflect or compress to a greater degree than other portions. Accordingly, the materials selected for lower plate 37 may also be utilized to contribute to the independent deflection and compression properties of support elements 40*a*-40*d*.

Outsole 31 may also include indentations that correspond with the various indentations 39*a*-39*e* in lower plate 37, as depicted in FIGS. 1A and 1B. In further configurations, however, indentations in outsole 31 may be absent such that outsole 31 extends around substantially all of the periphery of sole structure 30. Lower plate 37 is depicted as having a generally flat aspect, with the exception of areas 38*a*-38*d*. In further configurations, lower plate 37 may be contoured to include other raised areas, ribs, supports, or other non-planar features.

Support Element Structure

The support elements used in accordance with the arrangements described may be formed of any suitable material. For instance, the support elements may be fluid filled, such as those described in U.S. patent application Ser. No. 10/242,607, entitled, "Article of Footwear with a Sole Structure Having Fluid Filled Support Elements," filed Oct. 3, 2005 and incorporated herein by reference. In addition, the support elements may be formed of foam, rubber or a stiff plastic. Still further, the support elements may be mechanical elements that are adjustable.

Additional Support Element Configurations

Figure 3:
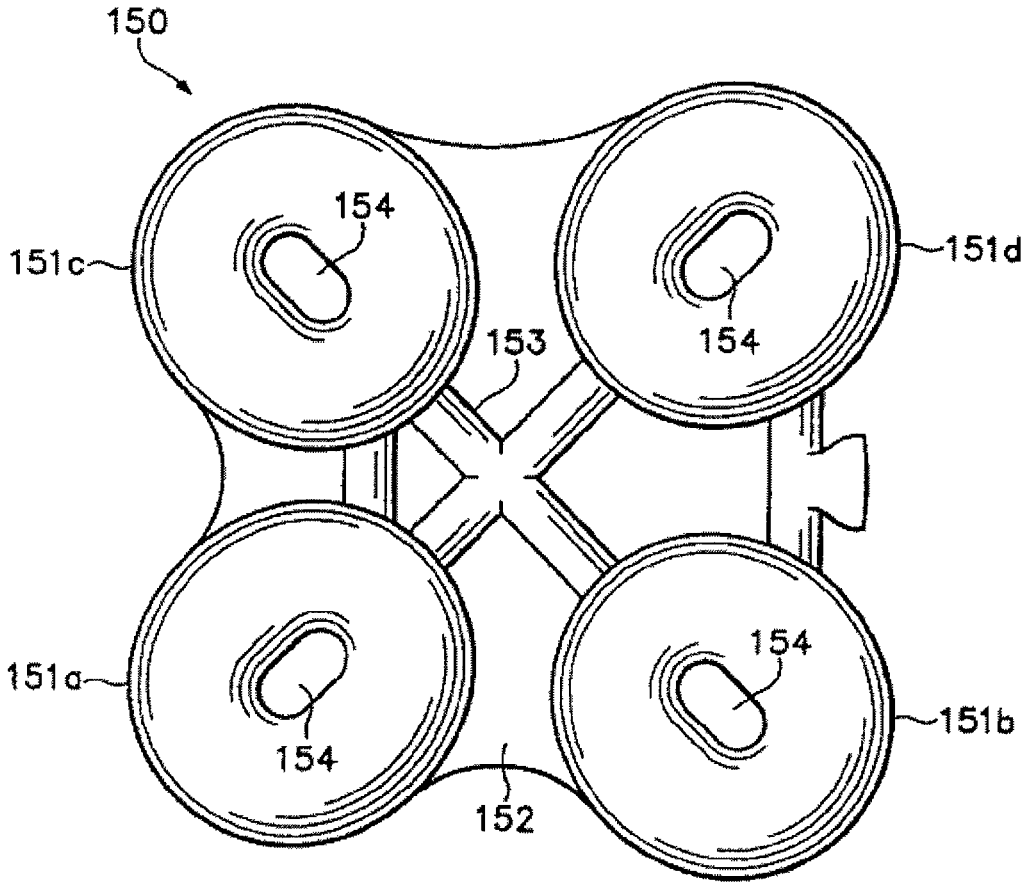
FIG. 3 is a top plan view of another support component having four support elements.
Figure 4:
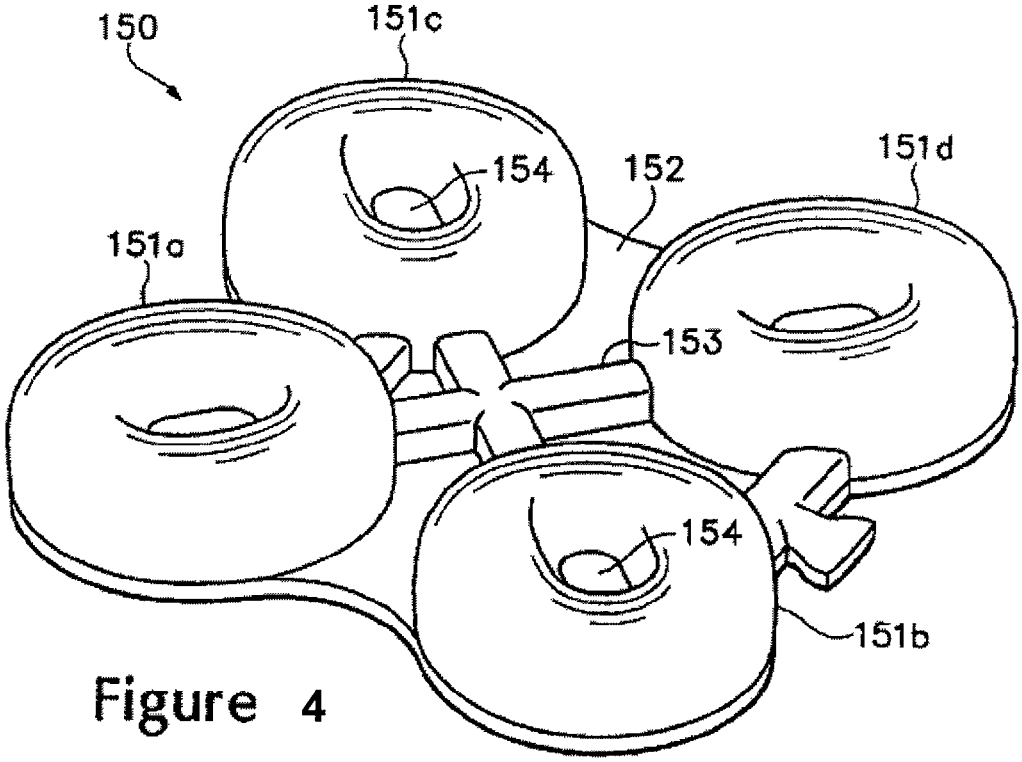
FIG. 4 is a perspective view of the support component depicted in FIG. 3.

With reference to FIGS. 3 and 4, a support component 150 is depicted as including four chambers 151*a*-151*d*. Support component 150 is formed from a barrier material that is substantially impermeable to a pressurized fluid contained by chambers 151*a*-151*d*. Each of chambers 151*a*-151*d* may be formed from a first barrier layer that is bonded to a second barrier layer. More particularly, the first barrier layer may define a first surface and a sidewall surface of chambers 151*a*-151*d*, and the second barrier layer may define a second surface of chambers 151*a*-151*d*. Accordingly, the barrier layers may be bonded together around the peripheries of chambers 151*a*-151*d* to define peripheral bonds that seal the pressurized fluid within support component 150. In further embodiments, each of the barrier layers may form portions of the sidewall surface such that the peripheral bonds are positioned between the first surface and the second surface.

Figure 5:
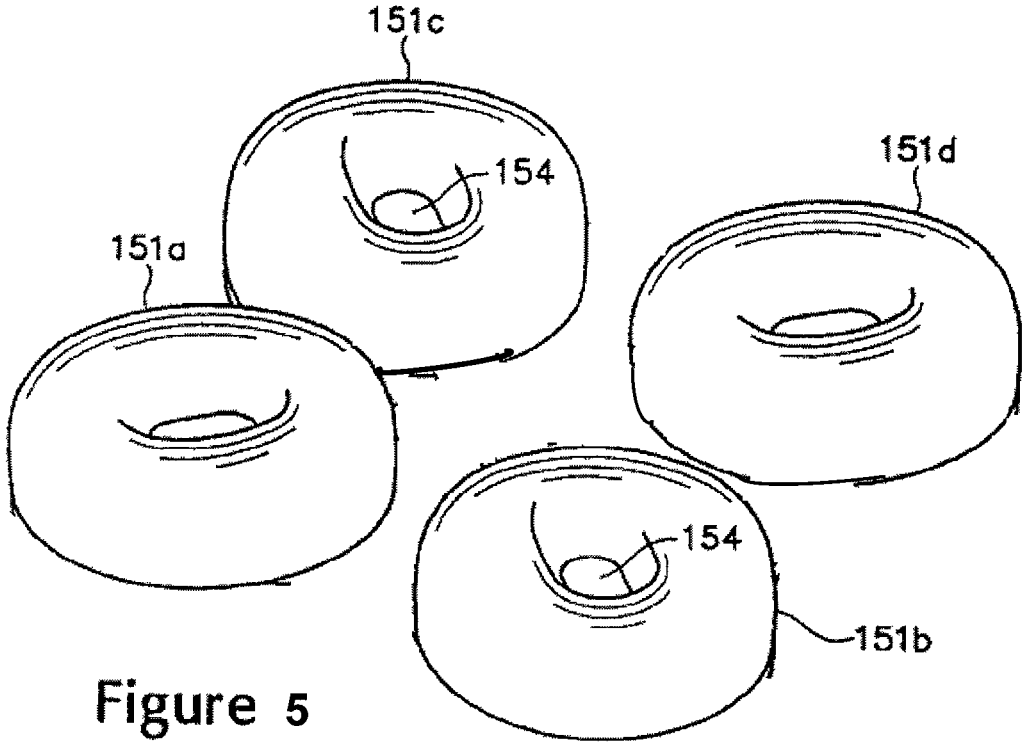
FIG. 5 is a perspective view of four additional support elements.

The barrier layers forming support component 150 extends between chambers 151*a*-151*d* to form a base 152 that connects chambers 151*a*-151*d*. When incorporated into footwear 100, base 152 is positioned adjacent outsole 131, but may be positioned adjacent plate 140. An x-shaped conduit 153 places each of chambers 151*a*-151*d* in fluid communication. Accordingly, an increase in pressure within one of chambers 151*a*-151*d* induces a corresponding increase in pressure in the other chambers 151*a*-151*d*. In some embodiments, conduit 153 may be absent such that chambers 151*a*-151*d* are not in fluid communication. Alternately, base 152 may be absent such that chambers 151*a*-151*d* are separate from each other, as depicted in FIG. 5.

Inserts that may limit the degree to which the first surface and second surface protrude outward due to the pressure of the fluid within chamber may be utilized with chambers 151*a*-151*d*. As depicted in FIGS. 3 and 4, however, each of chambers 151*a*-151*d* include an internal bond 154 that extends between opposite surfaces and limits the degree to which the opposite surfaces protrude outward. Accordingly, additional inserts may be absent from chambers 151*a*-151*d*. Each of chambers 151*a*-151*d* define various centrally-located indentations in areas corresponding with bond 154. Attachment members 141*a*-141*d* are each contoured to extend into the indentations.

Support component 150 or individual chambers 151*a*-151*d* may be utilized in place of support elements 110 and with lower plate 37. As described above, an advantage of indentations 39*a*-39*e* in lower plate 37 relates to the ability of support elements 110 to deflect independently as footwear 10 impacts the ground. When utilized with support component 150, for example, chambers 151*a*-151*d* may also deflect independently as footwear 10 impacts the ground. In addition, indentations 39*a*-39*e* decrease the overall mass of footwear 10 by decreasing the amount of material utilized in footwear 10.

Additional Footwear Configuration

Figure 6:
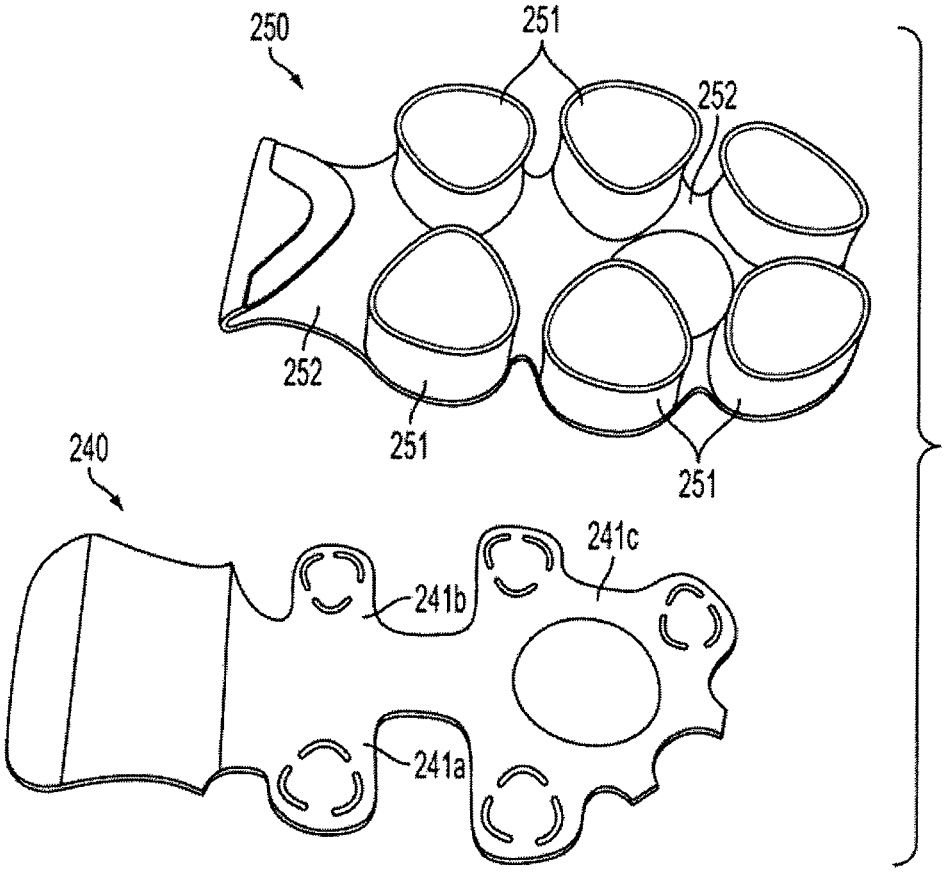
FIG. 6 is a lateral side elevational view of another article of footwear.

Footwear 10 is disclosed above as incorporating various support elements 110 (or support component 150) that include may include fluid-filled chambers. As an alternative to fluid-filled structures, an article of footwear may include an alternate arrangement as including an upper and a sole structure. Upper is secured to sole structure and defines a cavity for receiving a foot. In general, upper may have the general configuration disclosed above for upper 20, or upper may have any other conventional or non-conventional structure. Sole structure is secured to a lower surface of upper and includes an outsole and a midsole. Outsole forms a ground-engaging surface of sole structure and may have the general configuration of outsole 31 discussed above. In addition to other elements, midsole includes a plate 240 and a support component 250, shown in FIG. 6. As discussed in greater detail below, support component 250 includes six support elements 251 and a connecting web 252 joining support elements 251. Support component 250 may be formed from a variety of materials, including polymers. As examples of polymers, suitable materials for support component 250 include rubber, polyurethane foam, microcellular elastomeric foams, or ethylvinylacetate, for example.

Plate 240 is positioned between support component 250 and outsole and includes various indentations, three of which are identified as indentations 241*a*-241*c*. Whereas indentation 241*a* is located on a lateral side of footwear, each of indentations 241*b* and 241*c* are located on a medial side of footwear. As with lower plate 37 described above, an advantage of indentations 241*a*-241*c* relates to the ability of support elements 251 to deflect independently as footwear impacts the ground. In addition, indentations 241*a*-241*c* decrease the overall mass of footwear.

Conclusion

Based upon the above discussion, a variety of plate configurations may be utilized to modify the degree to which portions of a footwear sole deflect. More particularly, indentations in a plate may be utilized to decouple the deflection of one support element, whether formed from a fluid-filled structure or foam, from other support elements.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. A method of manufacturing an article of footwear comprising:

forming a sole structure including:

(a) forming a first plate including forming indentations extending inward from peripheral edges of the first plate and forming a plurality of raised portions located inward from the peripheral edges of the first plate, and (b) providing a plurality of support elements above the first plate and in the plurality of raised portions; and engaging the sole structure with an upper so that the first plate and the plurality of support elements of the sole structure are located at a heel region of the article of footwear, wherein a void is defined within the sole structure between the upper and the first plate, the void extending from a lateral side to a medial side of the sole structure, the void extending through the sole structure, and the plurality of support elements being located within the void; and wherein a depth of at least one indentation is approximately a diameter of at least one of the raised portions.

2. The method recited in claim 1, wherein the engaging includes locating the first plate such that one of the indentations extends inward from the lateral side of the sole structure and another indentation extends inward from the medial side of the sole structure.

3. The method recited in claim 1, wherein the step of providing the plurality of support elements includes positioning two of support elements adjacent the lateral side and also positioning two of support elements adjacent the medial side.

4. The method recited in claim 1, further including a step of forming the plurality of support elements to include a plurality of fluid-filled chambers.

5. The method recited in claim 4, wherein the step of forming the plurality of support elements includes pressurizing the chambers of the plurality of fluid-filled chambers.

6. The method recited in claim 1, further including a step of forming the plurality of support elements from a polymer foam material.

7. The method of claim 1, wherein the step of forming the sole structure further includes providing a second plate, and wherein the step of positioning the plurality of support elements includes positioning the plurality of support elements to extend between the first and second plates.

8. The method of claim 1, wherein the step of forming the first plate includes forming at least one of the indentations so as to have a depth and a location that allows one support element of the plurality of support elements to deflect or compress independently of a remainder of the plurality of support elements.

9. A method of manufacturing an article of footwear comprising:

forming a sole structure including:

(a) forming an upper plate, (b) forming a lower plate including forming a plurality of indentations extending inward from peripheral edges of the lower plate and forming a plurality of raised portions located inward from the peripheral edges of the lower plate, and (c) providing a plurality of support elements extending between the upper plate and the lower plate and in the plurality of raised portions, wherein the sole structure defines a void extending from a lateral side to a medial side of the sole structure and between the upper plate and the lower plate, and wherein at least one of the plurality of indentations extends between two of the support elements;

engaging the sole structure with an upper so that the void is located in a heel region of the article of footwear; and wherein a depth of at least one indentation is approximately a diameter of at least one of the raised portions.

10. The method of claim 9, wherein the plurality of support elements includes at least two support elements.

11. The method of claim 9, wherein the plurality of support elements includes at least four support elements.

12. The method of claim 9, wherein the plurality of indentations include indentations of varying depths.

13. The method of claim 9, wherein the step of forming the lower plate includes forming at least one of the plurality of indentations so as to have a depth and a location that allows one support element of the plurality of support elements to deflect or compress independently of a remainder of the plurality of support elements.

* * * * *